US008374854B2

(12) United States Patent
Douglas et al.

(10) Patent No.: US 8,374,854 B2
(45) Date of Patent: Feb. 12, 2013

(54) SPATIO-TEMPORAL SPEECH ENHANCEMENT TECHNIQUE BASED ON GENERALIZED EIGENVALUE DECOMPOSITION

(75) Inventors: Scott C. Douglas, University Park, TX (US); Malay Gupta, Schaumburg, IL (US)

(73) Assignee: Southern Methodist University, Dallas, TX (US)

( * ) Notice: Subject to any disclaimer, the term of this patent is extended or adjusted under 35 U.S.C. 154(b) by 734 days.

(21) Appl. No.: 12/413,070

(22) Filed: Mar. 27, 2009

(65) Prior Publication Data

US 2010/0076756 A1 Mar. 25, 2010

Related U.S. Application Data

(60) Provisional application No. 61/040,492, filed on Mar. 28, 2008.

(51) Int. Cl.
*G10L 21/02* (2006.01)

(52) U.S. Cl. ..... 704/226; 704/233; 704/500; 704/227; 704/228; 704/229

(58) Field of Classification Search ..... 704/226, 704/233, 500
See application file for complete search history.

(56) References Cited

U.S. PATENT DOCUMENTS

| | | | | |
|---|---|---|---|---|
| 5,487,129 | A * | 1/1996 | Paiss et al. | 704/233 |
| 5,721,694 | A * | 2/1998 | Graupe | 702/191 |
| 6,064,903 | A * | 5/2000 | Riechers et al. | 600/407 |
| 6,256,608 | B1 * | 7/2001 | Malvar | 704/230 |
| 7,003,451 | B2 * | 2/2006 | Kjorling et al. | 704/206 |
| 7,299,161 | B2 * | 11/2007 | Baxter et al. | 702/196 |
| 7,330,738 | B2 * | 2/2008 | Kang et al. | 455/570 |
| 7,343,284 | B1 * | 3/2008 | Gazor et al. | 704/226 |
| 7,369,989 | B2 * | 5/2008 | Absar et al. | 704/203 |
| 7,426,464 | B2 * | 9/2008 | Hui et al. | 704/227 |
| 7,630,891 | B2 * | 12/2009 | Oh et al. | 704/233 |
| 7,729,909 | B2 * | 6/2010 | Rigazio et al. | 704/233 |
| 7,996,215 | B1 * | 8/2011 | Wang et al. | 704/208 |
| 8,131,541 | B2 * | 3/2012 | Yen et al. | 704/216 |
| 8,175,200 | B2 * | 5/2012 | Chen | 375/346 |

(Continued)

OTHER PUBLICATIONS

S. Doclo, I. Do Oglou, and M. Moonen, "A novel iterative signal enhancement algorithm for noise reduction in speech," in Proc. Int. Conf. Spoken Language Process., Sydney, Australia, Dec. 1998, pp. 1435-1438.*

S. Doclo and M. Moonen, "GSVD-based optimal filtering for single and multimicrophone speech enhancement," IEEE Transactions Signal Processing, vol. 50, No. 9, pp. 2230-2244, Sep. 2002.*

(Continued)

*Primary Examiner* — Pierre-Louis Desir
*Assistant Examiner* — Fariba Sirjani
(74) *Attorney, Agent, or Firm* — Oblon, Spivak, McClelland, Maier & Neustadt, L.L.P.

(57) ABSTRACT

The present invention describes a speech enhancement method using microphone arrays and a new iterative technique for enhancing noisy speech signals under low signal-to-noise-ratio (SNR) environments. A first embodiment involves the processing of the observed noisy speech both in the spatial- and the temporal-domains to enhance the desired signal component speech and an iterative technique to compute the generalized eigenvectors of the multichannel data derived from the microphone array. The entire processing is done on the spatio-temporal correlation coefficient sequence of the observed data in order to avoid large matrix-vector multiplications. A further embodiment relates to a speech enhancement system that is composed of two stages. In the first stage, the noise component of the observed signal is whitened, and in the second stage a spatio-temporal power method is used to extract the most dominant speech component. In both the stages, the filters are adapted using the multichannel spatio-temporal correlation coefficients of the data and hence avoid large matrix vector multiplications.

9 Claims, 6 Drawing Sheets

U.S. PATENT DOCUMENTS

| | | | | |
|---|---|---|---|---|
| 2002/0165712 | A1* | 11/2002 | Souilmi et al. | 704/233 |
| 2003/0142765 | A1* | 7/2003 | Poklemba et al. | 375/341 |
| 2003/0204398 | A1* | 10/2003 | Haverinen et al. | 704/233 |
| 2004/0064314 | A1* | 4/2004 | Aubert et al. | 704/233 |
| 2005/0105644 | A1* | 5/2005 | Baxter et al. | 375/316 |
| 2006/0015331 | A1* | 1/2006 | Hui et al. | 704/227 |
| 2006/0153309 | A1* | 7/2006 | Tang et al. | 375/260 |
| 2007/0088544 | A1* | 4/2007 | Acero et al. | 704/226 |
| 2009/0287481 | A1* | 11/2009 | Paranjpe et al. | 704/226 |
| 2010/0136940 | A1* | 6/2010 | Hui et al. | 455/307 |
| 2010/0167679 | A1* | 7/2010 | Lopez et al. | 455/296 |
| 2010/0235171 | A1* | 9/2010 | Takagi et al. | 704/500 |
| 2011/0013306 | A1* | 1/2011 | Sawaguchi et al. | 360/40 |
| 2011/0257965 | A1* | 10/2011 | Hardwick | 704/208 |

OTHER PUBLICATIONS

Y. Ephraim and H. L. Vantrees, "A signal subspace approach for speech enhancement," IEEE Transactions Speech Audio Processing, vol. 3, No. 4, pp. 251-266, Jul. 1995.*

Y. Hu and P. C. Loizou, "A generalized subspace approach for enhancing speech corrupted by colored noise," IEEE Transactions Speech Audio Processing, vol. 11, No. 4, pp. 334-341, Jul. 2003.*

S. Amari, A. Cichocki, and H.S. Yang, "A new learning algorithm for blind signal separation," Adv. Neural Inform. Proc. Sys. 8 (Cambridge, MA:MIT Press, 1996), pp. 757-763.*

S. C. Douglas and A Cichocki, "Adaptive step size techniques for decorrelation and blind source separation," Proc. 32nd Ann. Asilomar Conf. Signals, Syst.,Comput., Pacific Grove, CA, vol. 2, pp. 1191-1195, Nov. 1998.*

* cited by examiner

Figure 2

Table 1a

```
win = bartlett(L);
wvec = zeros(L,1);
wvec((L + 1)/2) = 1;
W0 = eye(m,n);
W = kron(W0,wvec);
Rv = Mcorr([zeros((L-1)/2,n);v],[v;zeros((L-1)/2,n)],L);
Rv = Mwindow(Rv,win,L);
for t = 1:100
    RW = Mconv(Rv,Mtranspose(W,L),L);
    Rbar = Mconv(W,RW,L);
    Rbar = Mwindow(Rbar,win,L);
    d = 1/m*sum(sum(abs(Rbar)));
    c = 1/sqrt(d);
    W = (1+mu)*c*W - mu*c/d*Mconv(Rbar,W,L);
end
x_tilde = Mfilter(W,x,L);
```

Figure 3

Table 1b

```
wvec = zeros(L,1);
wvec((L + 1)/2) = 1;
b0 = zeros(n,1);
b0(ceil(n/2)) =1;
b = kron(w0,wvec);
Rv = Mcorr([zeros((L-1)/2,n);y_tilde],[y_tilde;zeros((L-1)/2,n)],L);
Rv = Mwindow(Rv,win,L);
for t = 1:100
    b = Mconv(b,R,L);
    b = Mwindow(b,win,L);
    b = allpass(b,L);
end
s_hat = Mfilter(b,y_tilde,L);
```

Figure 4

Table 2

```
win = bartlett(L);
wvec = zeros(L,1);
wvec((L + 1)/2) = 1;
W0 = eye(m,n);
W = kron(W0,wvec);
Rx = Mcorr([zeros((L-1)/2,n);x],[x;zeros((L-1)/2,n)],L);
Rx = Mwindow(Rx,win,L);
Rv = Mcorr([zeros((L-1)/2,n);v],[v;zeros((L-1)/2,n)],L);
Rv = Mwindow(Rv,win,L);
for t = 1:100
    RW1 = Mconv(Rx,Mtranspose(W,L),L);
    A1 = Mconv(W,RW1,L);
    A1 = Mwindow(A1,win,L);
    RW2 = Mconv(Rv,Mtranspose(W,L),L);
    A2 = Mconv(W,RW2,L);
    A2 = Mwindow(A2,win,L);
    absA1 = abs(A1);
    absA2 = abs(A2);
    f1 = sum(sum(absA1));
    f2 = sum(sum(absA2));
    G = f2/f1*(Mtriu(A1,L) - Mdiag(A1,L)) + Mtril(A2,L);
    G = Mwindow(G,win,L);
    d = sum(sum(abs(G)))/m;
    c = 1/sqrt(d);
    W = (1 + mu)*c*W - mu*c/d*Mconv(G,W,L);
end
y = Mfilter(W,x,L);
```

SPATIO-TEMPORAL SPEECH ENHANCEMENT TECHNIQUE BASED ON GENERALIZED EIGENVALUE DECOMPOSITION

CROSS-REFERENCE TO RELATED APPLICATIONS

This application claims the benefit of priority under 35 U.S.C. §120 from Provisional U.S. Application Ser. No. 61/040,492, filed Mar. 28, 2008, herein incorporated by reference.

STATEMENT REGARDING FEDERALLY SPONSORED RESEARCH

The present invention was made in part with U.S. Government support under Contract #2005*N354200*000, Project #100905770351. The U.S. Government may have certain rights to this invention.

BACKGROUND OF THE INVENTION

Field of the Invention

The present invention relates to a mathematical procedure for enhancing a soft sound source in the presence of one or more loud sound sources and to a new iterative technique for enhancing noisy speech signals under low signal-to-noise-ratio (SNR) environments.

The present invention includes the use of various technologies referenced and described in the documents identified in the following LIST OF REFERENCES, which are cited throughout the specification by the corresponding reference number in brackets:

List of References

[1] S. F. Boll, "Suppression of acoustic noise in speech using spectral subtraction," *IEEE Transactions Acoustics Speech Signal Processing*, vol. 27, no. 2, pp. 113-120, 1979.

[2] M. Berouti, R. Schwartz, and J. Makhoul, "Enhancement of speech corrupted by acoustic noise," in *Proc. IEEE Intl. Conf., Acoustics Speech Signal Processing*, vol. 4, April 1979, pp. 208-211.

[3] Y. Ephraim and D. Malah, "Speech enhancement using a minimum mean-square error short-time spectral amplitude estimator," *IEEE Transactions Acoustics Speech Signal Processing*, vol. 32, no. 6, pp. 1109-1121, 1984.

[4] "Speech enhancement using a minimum mean-square error log-spectral amplitude estimator," *IEEE Transactions Acoustics Speech Signal Processing*, vol. 33, no. 2, pp. 443-445, 1985.

[5] Z. Goh, K. C. Tan, and B. T. G. Tan, "Postprocessing method for suppressing musical noise generated by spectral subtraction," *IEEE Transactions Speech Audio Processing*, vol. 6, no. 3, pp. 287-292, May 1998.

[6] N. Virag, "Single channel speech enhancement based on masking properties of the human auditory system," *IEEE Transactions Speech Audio Processing*, vol. 7, no. 2, pp. 126-137, March 1999.

[7] Y. Ephraim and H. L. Vantrees, "A signal subspace approach for speech enhancement," *IEEE Transactions Speech Audio Processing*, vol. 3, no. 4, pp. 251-266, July 1995.

[8] U. Mittal and N. Phamdo, "Signal/Noise KLT based approach for enhancing speech degraded by colored noise," *IEEE Transactions Speech Audio Processing*, vol. 8, no. 2, pp. 159-167, March 2000.

[9] Rezayee and S. Gazor, "An adaptive KLT approach for speech enhancement," *IEEE Transactions Speech Audio Processing*, vol. 9, no. 2, pp. 87-95, February 2001.

[10] Y. Hu and P. C. Loizou, "A generalized subspace approach for enhancing speech corrupted by colored noise," *IEEE Transactions Speech Audio Processing*, vol. 11, no. 4, pp. 334-341, July 2003.

[11] M. Brandstein and D. Ward, Eds., Microphone Arrays: *Signal Processing Techniques and Applications*. Springer, 2001.

[12] B. D. V. Veen and K. M. Buckley, "Beamforming: A versatile approach to spatial filtering," *IEEE ASSP. Mag.*, pp. 4-24, April 1988.

[13] S. Doclo and M. Moonen, "GSVD-based optimal filtering for single and multimicrophone speech enhancement," *IEEE Transactions Signal Processing*, vol. 50, no. 9, pp. 2230-2244, September 2002.

[14] F. T. Luk, "A parallel method for computing the generalized singular value decomposition," *Journal Parallel Distributed Computing*, vol. 2, no. 3, pp. 250-260, August 1985.

[15] G. H. Golub and C. F. V. Loan, *Matrix Computations*, 3rd ed. The John Hopkins University Press, 1996.

[16] S. H. Jensen, P. C. Hansen, S. D. Hansen, and J. A. Sorensen, "Reduction of broad-band noise in speech by truncated QSVD," *IEEE Transactions Speech Audio Processing*, vol. 3, no. 6, pp. 439-448, November 1995.

[17] K. I. Diamantaras and S. Y. Kung, *Principal Component Neural Networks: Theory and Applications*. Wiley-Interscience, 1996.

[18] S. C. Douglas and M. Gupta, "Scaled natural gradient algorithms for instantaneous and convolutive blind source separation," *IEEE Int. Conf. Acoust., Speech, Signal Processing*, Honolulu, Hi., vol. II, pp. 637-640, April 2007.

[19]H. Lev-Ari and Y. Ephraim, "Extension of the signal subspace speech enhancement approach to colored noise," *IEEE Signal Processing Lett.*, vol. 10, no. 4, pp. 104-106, April 2003.

[20] M. Gupta and S. C. Douglas, "Signal deflation and paraunitary constraints in spatio-temporal fastica-based convolutive blind source separation of speech mixtures," in 2007 *IEEE Workshop Applications of Signal Processing to Audio and Acoustics*, New Paltz, N.Y., October 2007.

The entire contents of each of the above references are incorporated herein by reference. The techniques disclosed in the references can be utilized as part of the present invention.

DISCUSSION OF THE BACKGROUND

A speech enhancement system is a valuable device in many applications of practical interest such as hearing aids, cell phones, speech recognition systems, surveillance, and forensic applications. Early speech enhancement systems were based on a single channel operation due to their simplicity. Spectral subtraction [1] is a simple and popular single channel speech enhancement technique that achieved marked reduction in background noise. These systems operate in the discrete Fourier domain and process noisy data in frames. An estimate of the noise power spectrum is subtracted from the noisy speech in each frame and data is reconstructed in the time domain by using methods like the overlap-add or overlap-save methods. Although effective in high signal-to-noise-ratio (SNR) scenarios, an annoying artifact of spectral subtraction is an automatic generation of musical tones in the enhanced speech. This effect is particularly prominent in low signal-to-noise-ratios (SNR) (<5 dB) and makes the enhanced speech less understandable to humans. Over the years, several solutions dealing with the problem of musical noise have been proposed in the speech enhancement literature [2], [3], [4], [5], [6]. These techniques employ perceptually constrained criteria to trade-off background noise reduction with speech distortion. However, in low SNR regimes, the problem still persists.

In the early 1990s it was realized that the Karhunen-Loeve transform (KLT), instead of the popular DFT, could be effectively utilized in a speech enhancement system. This was motivated by the fact that KLT provides a signal-dependent basis as opposed to a fixed basis used by the DFT based system. This fact led researchers to propose subspace-based speech enhancement systems in [7] as an alternative to spectral subtraction algorithms. These methods require the eigenvalue decomposition (EVD) of the covariance of the noisy speech and are successful in eliminating musical noise to a large extent. The key idea in subspace-based techniques is to decompose the vector space of noisy speech into two mutually orthogonal subspaces corresponding to signal-plus-noise and noise-only subspaces. The subspaces are identified by performing an eigenvalue decomposition (EVD) of the correlation matrix of the noisy speech vector via the Karhunen-Loéve transform (KLT) in every frame. The components of the noisy speech corresponding to the noise-only subspace are nulled out, whereas components corresponding to the signal-plus-noise subspace are enhanced. Subspace-based algorithms perform better than the spectral-subtraction-based algorithms due to the better signal representation provided by the KLT and offer nearly musical-noise-free enhanced speech. However, the original subspace algorithm is optimal only under the assumption of stationary white noise. In other words, these EVD-based methods are designed for the uncorrelated noise case. For correlated noise scenarios, several extensions of the original subspace method have been proposed in the literature [8][9][10][16][19]. The technique in [8] first identifies whether the current frame is speech-dominated or noise-dominated, and then uses different processing strategies corresponding to each case. The technique in [9] uses a diagonal matrix instead of an identity matrix to approximate the noise power spectrum. The methods in [10] [16] use generalized eigenvalue decomposition and quotient (generalized) singular value decomposition, respectively, to account for the correlated nature of the additive noise. Explicit solutions to the linear time-domain and frequency-domain estimators were developed in [19], where the solution matrix whitens the colored noise before the KLT is applied. All of the above methods claim better performance in colored noise scenarios over the original subspace algorithm [7], albeit with higher computational complexity.

Microphone arrays have recently attracted a lot of interest in the signal and speech processing communities [11] due to their ability to exploit both the spatial- and the temporal-domains simultaneously. These multimicrophone systems are capable of coupling a speech enhancement procedure with beamforming [12] to ensure effective nulling of the background noise. Subspace algorithms have recently been extended to the multimicrophone case in [13] via use of the generalized singular value decomposition (GSVD). Specialized algorithms [14], [15] were utilized to compute the GSVD of two matrices corresponding to noise-only data and signal-plus-noise data. An alternate formulation of the GSVD via the use of noise whitening was previously suggested in [16]. The results are promising, but the issue of complexity remains. In a similar vein, the GEVD-based method of [10] can also be extended to the multimicrophone case, however, the need for long filters per channel poses a serious challenge in the implementation of GEVD-based systems. For example, in an n microphone system with L-taps per channel, the direct subspace computations will involve an nL×nL correlation matrix. Specific values of n=4, and L=4 result in a 4096×4096 correlation matrix, which is computationally expensive to handle on most small-form systems. Hence, alternative methods are sought to reduce this computational burden.

SUMMARY OF THE INVENTION

Accordingly, one embodiment of the present invention is a speech enhancement method that includes steps of obtaining a speech signal using at least one input microphone, calculating a whitening filter using a silence interval in the obtained speech signal, applying the whitening filter to the obtained speech signal to generate a whitened speech signal in which noise components present in the obtained speech signal are whitened, estimating a clean speech signal by applying a multi-channel filter to the generated whitened speech signal and outputting the clean speech signal via an audio device.

An object of the present invention is the development of a new speech enhancement algorithm based on an iterative methodology to compute the generalized eigenvectors from the spatio-temporal correlation coefficient sequence of the noisy data. The multichannel impulse responses produced by the present procedure closely approximate the subspaces generated from select eigenvectors of the (nL×nL)-dimensional sample autocorrelation matrix of the multichannel data. An advantage of the present technique is that a single filter can represent an entire nL-dimensional signal subspace by multichannel shifts of the corresponding filter impulse responses. In addition, the present technique does not involve dealing with large matrix vector multiplications, nor involve any matrix inversions. These facts make the present scheme very attractive and viable for implementation in real-time systems.

Another object of the present invention is related to a new methodology of processing the noisy speech data in the spatio-temporal domain. The present invention follows a technique that is closely related to the GEVD processing techniques. Similar to the GEVD processing, the first stage in the present method is the noise-whitening of the data, the second stage a spatio-temporal version of the well known power method [17] is used to extract the dominant speech component from the noisy data. A significant benefit of the present method is substantial reduction in the computational complexity. Because the whitening stage is separate in the present method, it is also possible to design invertible multichannel whitening filters whose effect from the output of the power method stage can be removed to nullify the whitening effects from the enhanced speech power spectrum.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, in which like reference numerals refer to identical or corresponding parts throughout the several views, and in which:

FIG. 2: illustrates a table providing an example of Pseudo Code for an Iterative Whitening process FIG. 3: illustrates a table providing an example of Pseudo Code for an Spatio-Temporal Power Method;

FIG. 4: illustrates a table providing an example of Pseudo Code for an Algorithm Implementation of one embodiment of the claimed invention;

DETAILED DESCRIPTION OF THE PREFERRED EMBODIMENTS

Figure 1:
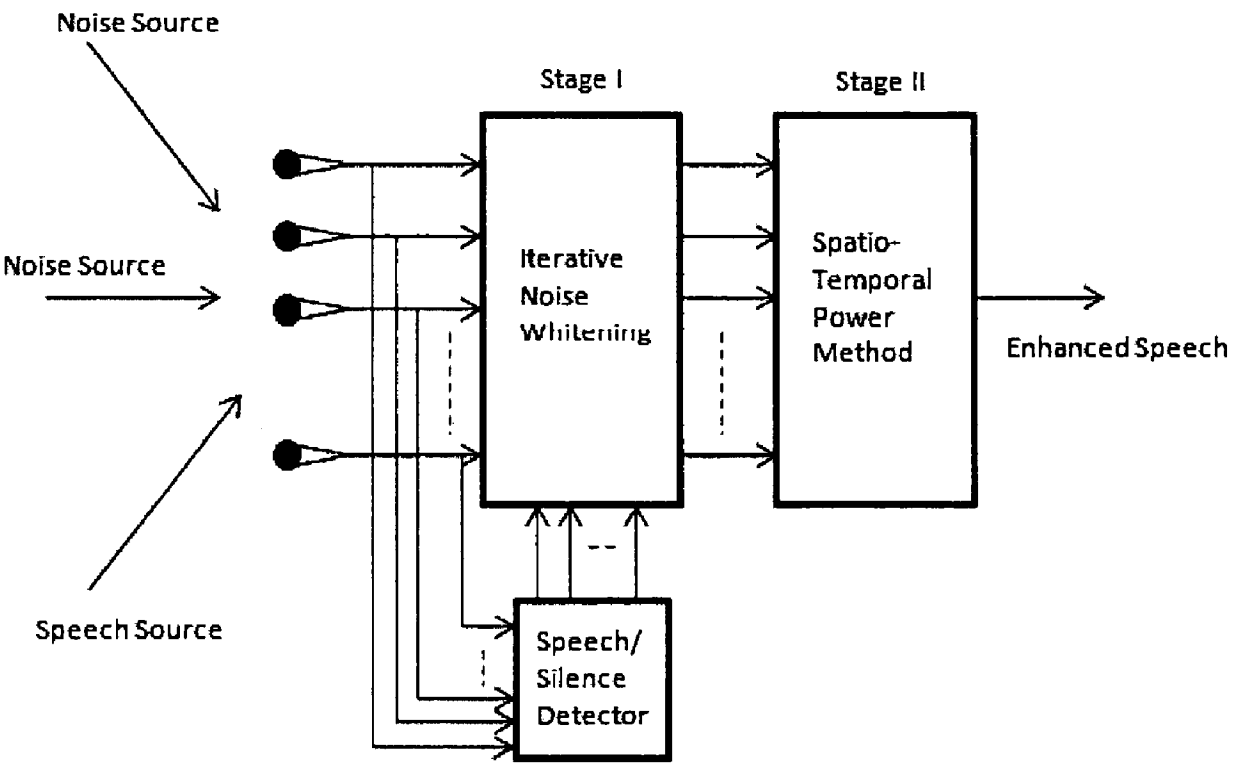
FIG. 1: illustrates a block diagram of one embodiment of the present invention.

One embodiment of the present invention relates to a method of Spatio-Temporal Eigenfiltering using a signal model. For instance, letting s(l) denote a clean speech source signal which is measured at the output of an n-microphone array in the presence of colored noise v(l) at time instant l. The output of the $j^{th}$ microphone is given as $$y_j(l) = v_j(l) + \sum_{p=-\infty}^{\infty} h_{jp}s(l-p) = v_j(l) + x_j(l) \tag{1}$$

where $\{h_{jp}\}$ are the coefficients of the acoustic impulse response between the speech source and the $j^{th}$ microphone, and $x_j(l)$ and $v_j(l)$ are the filtered speech and noise component received at the $j^{th}$ microphone, respectively. The additive noise $v_j(l)$ is assumed to be uncorrelated with the clean speech signal and possesses a certain autocorrelation structure. One of the goals of the speech enhancement system is to compute a set of filters $w_j$, $j=0, \ldots, n-1$ such that the speech component of $x_j(l)$ is enhanced while the noise component $v_j(l)$ is reduced. The filters $w_j$ are usually finite impulse response (FIR) filters due to the finite reverberation time of the environment. In fact, acoustic impulse responses decay with time such that only a finite number of tap values $h_{jp}$ in Eq. (1) are essentially non-zero. The vector model of signal corresponding to an n-element microphone array can be written as $$y(l)=x(l)+v(l) \tag{2}$$

where $y(l)=[y_1(l)y_2(l) \ldots y_n(l)]^T$, $x(l)=[x_1(l)x_2(l) \ldots x_n(l)]^T$, and $v(l)=[v_1(l)v_2(l) \ldots v_n(l)]^T$ are the observed signal, the clean speech signal and the noise signal respectively.

With regard to Spatio-Temporal Eigenfiltering, a goal is to transform the speech enhancement problem into an iterative multichannel filtering task in which the output of the multichannel filter $\{W_p(k)\}$ at time instant/and iteration k can be written as $$z_k(l) = \sum_{p=0}^{L} W_p(k)y(l-p). \tag{3}$$

where $\{W_p(k)\}$ is the n×n multichannel enhancement filter of length L at iteration k, and the n-dimensional signal $z_k(l)$ is the output of this multichannel filter. Upon filter convergence for sufficiently large k, one of the signals in $z_k(l)$ will contain a close approximation of the original signal $x_i(l)$. Equation (3) can further be written by substituting the value of y(l) as $$z_k(l) = \sum_{p=0}^{L} W_p(k)(v(l-p) + x(l-p)). \tag{4}$$

One of the goals of the present invention is to adapt the matrix coefficient sequence $\{W_p(k)\}$ to maximize the signal-to-noise ratio (SNR) at the system output. To achieve this goal, the power in $z_k(l)$ at the $k^{th}$ iteration is given by the following expression for P(k):

$$\begin{aligned} P(k) &= tr\left\{\frac{1}{N}\sum_{l=N(k-1)+1}^{Nk} z_k(l)z_k^T(l)\right\} \\ &= \sum_{p=0}^{L}\sum_{q=0}^{L} tr\{W_p(k)Ry_{q-p}W_q^T(k)\}, \end{aligned} \tag{5}$$

where N is the length of the data sequence, the notation tr{.} corresponds to the trace of a matrix, and $\{Ry_p\}$ denotes the multichannel autocorrelation sequence of y and is given by $$Ry_p = \frac{1}{N}\sum_{l=N(k-1)+1}^{Nk} y(l)y^T(l-p), \quad -\frac{L}{2} \le p \le \frac{L}{2}. \tag{6}$$

Note that $\{W_p(k)\}$ is assumed to be zero outside the range $0 \leqq p \leqq L$, and $\{Ry_p\}$ is assumed to be zero outside the range $|p| \leqq (L/2)$. Under the assumption of uncorrelated speech and noise, the total signal power can be written as $P(k)=P_x(k)+P_v(k)$, where $$\begin{aligned} P_x(k) &= \sum_{p=0}^{L}\sum_{q=0}^{L} tr\{W_p(k)Rx_{q-p}W_q^T(k)\} \\ P_v(k) &= \sum_{p=0}^{L}\sum_{q=0}^{L} tr\{W_p(k)Rv_{q-p}W_q^T(k)\}, \end{aligned} \tag{7)(8}$$

The problem of SNR maximization in the presence of colored noise is closely related to the problem of the generalized eigenvalue decomposition (GEVD). This problem has also been referred to as oriented principal component analysis (OPCA) [17]. The nomenclature is consistent with the fact that the generalized eigenvectors point in directions which maximize the signal variance and minimize the noise variance. However, since both $\{Rx_p\}$ and $\{Rv_p\}$ are not directly available, the values in $\{Rv_p\}$ are typically estimated during an appropriate silence period of the noisy speech in which there is no speech activity. Letting the number of samples of the noise sequence be denoted as $N_v$ (<<N) then the multichannel autocorrelation sequence corresponding to the noise process can be written as $$R_{V_p} = \frac{1}{N_v}\sum_{l=N_v(k-1)+1}^{N_v k} v(l)v^T(l-p), \quad -\frac{L}{2} \le p \le \frac{L}{2}. \tag{9}$$

As for the replacement of $\{Rx_p\}$, the multichannel autocorrelation sequence $\{Ry_p\}$ is used to find the stationary points of the following spatio-temporal power ratio:

$$J(\{W_p(k)\}) = \frac{tr\left\{\sum_{p=0}^{L}\sum_{q=0}^{L} W_p(k) Ry_{q-p} W_q^T(k)\right\}}{tr\left\{\sum_{p=0}^{L}\sum_{q=0}^{L} W_p(k) R_{V\,q-p} W_q^T(k)\right\}}. \tag{10}$$

The function $J(\{W_p(k)\})$ is the spatio-temporal extension of the generalized Rayleigh quotient, and the solution that maximizes equation (10) are the generalized eigenvectors (or eigenfilters) of the multichannel autocorrelation sequence pair $(\{Rx_p\}, \{Ry_p\})$. For sufficiently many iterations k, the multichannel FIR filter sequence $\{W_p(k)\}$ is designed to satisfy the following equations:

$$\sum_{p=0}^{L}\sum_{q=0}^{L} W_p(k) R_{V\,q-p} W_q^T(k) = \begin{cases} \Lambda & \text{if } |q-p| = 0 \\ 0 & \text{otherwise} \end{cases} \tag{11)(12}$$

$$\sum_{p=0}^{L}\sum_{q=0}^{L} W_p(k) R_{V_{q-p}} W_q^T(k) = \begin{cases} I & \text{if } |q-p| = 0 \\ 0 & \text{otherwise.} \end{cases}$$

where $\Lambda$ and $\{W_p\}$ denote the generalized eigenvalues and eigenvectors of $(\{Rx_p\}, \{Ry_p\})$. This solution maximizes the energy of the speech component of the noisy mixture while minimizing the noise energy at the same time.

The present invention also addresses spatio-temporal generalized eigenvalue decomposition. The present method relies on multichannel correlation coefficient sequences of the noisy speech process and noise process defined in (6) and (9). Next, the multichannel convolution operations needed for the update of the filter sequence $\{W_p\}$ are defined as $$\overline{Ry}_q(k) = \begin{cases} \sum_{p=0}^{L} \mathcal{H}(Ry_{q-p}) W_p^T(k) & \text{if } -\frac{L}{2} \le q \le \frac{L}{2} \\ 0 & \text{otherwise.} \end{cases} \tag{13)-(16}$$

$$Gy_p(k) = \begin{cases} \sum_{q=0}^{L} W_q(k) \overline{Ry}_{p-q}(k) & \text{if } 0 \le p \le L \\ 0 & \text{otherwise.} \end{cases}$$

$$\overline{R_{V_q}}(k) = \begin{cases} \sum_{p=0}^{L} \mathcal{H}(R_{V\,q-p}) W_p^T(k) & \text{if } -\frac{L}{2} \le q \le \frac{L}{2} \\ 0 & \text{otherwise.} \end{cases}$$

$$G_{V_p}(k) = \begin{cases} \sum_{q=0}^{L} W_q(k) \overline{R_V}_{p-q}(k) & \text{if } 0 \le p \le L \\ 0 & \text{otherwise.} \end{cases}$$

In the above set of equations, H(.) denotes a form of multichannel weighting on the autocorrelation sequences necessary to ensure the validity of the autocorrelation sequence for an FIR filtering operations needed in the algorithm update. Through numerical simulations it has been determined that this weighting is necessary both on the autocorrelation sequence itself as well as its filtered version at each iteration of the algorithm. This weighting amounts to multiplying each element of the resultant matrix sequence by a Bartlett window centered at p=q, although other windowing functions common in the digital signal processing literature can also be used. Next, we define the scalar terms $$f_2(k) = \frac{1}{n}\sum_{i=1}^{n}\sum_{j=1}^{n}\sum_{p=0}^{L} |g_{ijp}^{y}(k)|, \tag{17}$$

$$f_1(k) = \frac{1}{n}\sum_{i=1}^{n}\sum_{j=1}^{n}\sum_{p=0}^{L} |g_{ijp}^{v}(k)|,$$

where $g_{ijp}^{y}(k)$ and $g_{ijp}^{v}(k)$ are the elements of coefficient sequence $G_{y_p}(k)$ and $G_{v_p}(k)$ respectively. Following these definitions, define the scaled gradient [18] for the update of spatio-temporal eigenvectors as $$G_p(k) = \frac{f_2(k)}{f_1(k)} \overline{triu}[Gy_p(k)] + tril[G_{V_p}(k)], \tag{18}$$

where triu[.] with its overline denotes the strictly upper triangular part of its matrix argument and tril[.] denotes the lower triangular part of its matrix argument. In the first instantiation of the invention, the correction term in the update process is defined as $$U_p(k) = \sum_{q=0}^{L} \mathcal{H}(G_{p-q}(k)) W_q(k),\ 0 \le p \le L \tag{19}$$

and the final update for the weights become $$W_p(k+1) = (1+\mu)c(k)W_p(k) - \mu\frac{c(k)}{d(k)}U_p(k), \tag{20}$$

where $$d(k) = \frac{1}{N}\sum_{i=1}^{n}\sum_{j=1}^{n}\sum_{p=0}^{L} |g_{ijp}(k)|, \text{ and } c(k) = \frac{1}{d(k)}.$$

Typically, step sizes in the range $0.35 \leqq \mu \leqq 0.5$ have been chosen and appear to work well. The enhanced signal can be obtained from the output of this system as the first element $y_1(l)$ of the vector $y(l)=[y_1(l)y_2(l) \ldots y_n(l)]^T$ at time instant l.

In Table 2 shown in FIG. 4, there is illustrated a pseudo code for the algorithm implementation in MATLAB, a common technical computing environment well-known to those skilled in the art, in which the functions starting with the letter "m" represent the multichannel extensions of single channel standard functions on sequences.

In addition, in a further embodiment, the present invention addresses an alternate implementation of the previously-described procedure employing a spatio-temporal whitening system with an Iterative Multichannel Noise Whitening Algorithm.

In this embodiment, a two stage speech enhancement system is used, in which the first stage acts as a noise-whitening system and the second stage employs a spatio-temporal power method on the noise-whitened signal to produce the enhanced speech. A significant advantage of the present method is its computational simplicity which makes the algorithm viable for applications on many common computing devices such as cellular telephones, personal digital assistants, portable media players, and other computational devices. Since all the processing is performed on the spatio-temporal correlation coefficient sequences, the method avoids large matrix-vector manipulations.

The first step in the present technique is to whiten the noise component of the observed noisy data. As is common in speech enhancement systems, it is assumed that access to an interval in the noisy speech where the speech is signal is absent is available. Such an interval is often referred to as the silence interval and can be detected by using a speech/silence detector or a voice activity detector (VAD). For purposes of the present invention it is assumed that the speech source is silent for $N_v+L+1$ sample times from $l=N_v(k-1)-(L/2)$ to $l=N_v(k-1)+(L/2)$. From this noise-only segment, it is possible to compute a whitening filter which is then applied to the rest of the noisy speech in order to whiten the noise component present in it. The present method involves designing a multichannel whitening filter of length L which iteratively whitens the spatio-temporal autocorrelation sequence corresponding to the noise process defined as $$R_{V_p} = \frac{1}{N_v}\sum_{l=N_v(k-1)+1}^{N_v k} v(l)v^T(l-p), \quad -\frac{L}{2} \le p \le \frac{L}{2}, \tag{21}$$

where $N_v$ is the number of noise samples used in the computation of the whitening filter. After sufficiently many iterations k, the multichannel FIR filter sequence $\{W_p(k)\}$ is designed to satisfy the following equation $$\sum_{p=0}^{L}\sum_{q=0}^{L} W_p(k)R_{V_{q-p}}W_q^T(k) = \begin{cases} I & \text{if } |q-p| = 0 \\ 0 & \text{otherwise.} \end{cases} \tag{22}$$

where I is an n×n identity matrix. Note that $\{W_p(k)\}$ is assumed to be zero outside the range $0 \leqq p \leqq L$ and $\{Rv_p\}$ is assumed to be zero outside the range $$-\frac{L}{2} \le p \le \frac{L}{2}.$$

The filter coefficient sequence $\{W_p(k)\}$ can be updated in terms of the following multichannel sequences of length L defined as $$\overline{R_{V_q}}(k) = \begin{cases} \sum_{p=0}^{L} \mathcal{H}(R_{V_{q-p}})W_p^T(k) & \text{if } -\frac{L}{2} \le q \le \frac{L}{2} \\ 0 & \text{otherwise.} \end{cases} \tag{23)(24)(25}$$

$$G_{V_p}(k) = \begin{cases} \sum_{q=0}^{L} W_q(k)\overline{R_V}_{p-q}(k) & \text{if } 0 \le p \le L \\ 0 & \text{otherwise.} \end{cases}$$

$$\tilde{U}_p(k) = \sum_{q=0}^{L} \mathcal{H}(G_{V_{p-q}}(k))W_q(k),\ 0 \le p \le L$$

and the final update for $\{W_p\}$ becomes $$W_p(k+1) = (1+\mu)c(k)W_p(k) - \mu\frac{c(k)}{d(k)}\tilde{U}_p(k),\ 0 \le p \le L \tag{26}$$

-continued where $$d(k) = \frac{1}{n}\sum_{i=1}^{n}\sum_{j=1}^{n}\sum_{p=0}^{L}|g_{ijp}(k)|,$$

and $$c(k) = \frac{1}{d(k)}$$

are the gradient scaling factors [18] chosen to stabilize the algorithm and reduce the sensitivity of the gradient based update on the step size. Typically, step sizes in the range $0.35 \leqq \mu \leqq 0.5$ have been chosen and appear to work well. In the above set of equations, H(.) denotes a form of multichannel weighting on the autocorrelation sequences as described previously. After the filter convergence we obtain the noise-whitened signal as $$\tilde{y}_k(l) = \sum_{p=0}^{L} W_p(k)y(l-p) \tag{27}$$

Once the noise-whitened vector signal $\tilde{y}_k(l)$ is obtained, the spatio-temporal power method is applied to this vector signal in order to obtain the enhanced speech.

The present embodiment also includes a spatio-temporal power method which is the second stage in the present technique and involves the design of a multichannel filter $\{b_p(k)\}$, where $\{b_p(k)\}$ is a (1×n) vector sequence, which upon convergence yields a single channel signal $\hat{x}(l)$ which closely resembles the clean speech signal s(l) with some delay D. The output of the multichannel filter $\{b_p(k)\}$ at time instant k is given as $$\hat{s}_k(l) = \sum_{p=0}^{L} b_p(k)\tilde{y}(l-p) \tag{28}$$

As a design criterion for the filter sequence $\{b_p(k)\}$, the power of the output signal $\hat{s}_k(l)$, is maximized, i.e., $$\text{maximize } \mathcal{J}(\{b_p\}) = \frac{1}{2}\sum_{k=1}^{N}\hat{s}_k^2(l) \tag{29}$$

such that $$\sum_{p=0}^{L} b_p b_{p+q}^T = \delta_q,\ -\frac{L}{2} \le q \le \frac{L}{2} \tag{30}$$

The constraints in (30) correspond to the paraunitary constraints on the filter $\{b_p(k)\}$. Note that in the conventional power method, unit-norm constraints are often placed on the filter coefficients; however, as a recent simulation study [20] indicates, the paraunitary constraints have beneficial impact not only on the robustness of the algorithms but also on the quality of the output speech. Our method for solving (29)-(30) employs a gradient ascent procedure in which each matrix tap $b_p$ is replaced by the derivative of $J(b_p)$ with respect to $b_p$, after which the updated coefficient sequence is adjusted to maintain the paraunitary constraints in (30). It can be shown that $$\frac{\partial J(\{b_p\})}{\partial b_p} = \sum_{q=0}^{L} b_q R_{p-q}, \tag{31}$$

where the multichannel autocorrelation sequence $R_p$ is given by $$R_p = \frac{1}{N}\sum_{l=1}^{N} \tilde{y}_k(l)\tilde{y}_k^T(l-p), -\frac{L}{2} \le p \le \frac{L}{2}. \tag{32}$$

Thus, the first step of our procedure at each iteration sets $$\tilde{b}_p(k) = \sum_{q=0}^{L} b_q(k) R_{p-q}, 0 \le p \le L. \tag{33}$$

At this point, the coefficient sequence $\{\tilde{b}_p(k)\}$ needs to be modified to enforce the paraunitary constraints in (30). We modify the coefficient sequence such that $$\{b_p(k+1)\} = A(\tilde{b}_0(k)\tilde{b}_1(k), \ldots, \tilde{b}_L(k)), 0 \le p \le L \tag{34}$$

where A is a mapping that forces $\{b_p(k+1)\}$ to satisfy (30) at each iteration. Such constraints can be enforced at each iteration by normalizing each complex Fourier-transformed filter weight in each filter channel by its magnitude. After sufficiently many iterations of (33)-(34), the signal $\hat{s}_k(l)$ closely resembles the clean speech signal at time instant l. A block diagram of the propose system is shown in FIG. 1, and in Tables 1a and 1b in FIGS. 2 and 3, respectively, pseudo code for the algorithm implementation in MATLAB have been provided. The functions starting with M represent the multichannel extensions of single channel standard functions.

Figure 5:
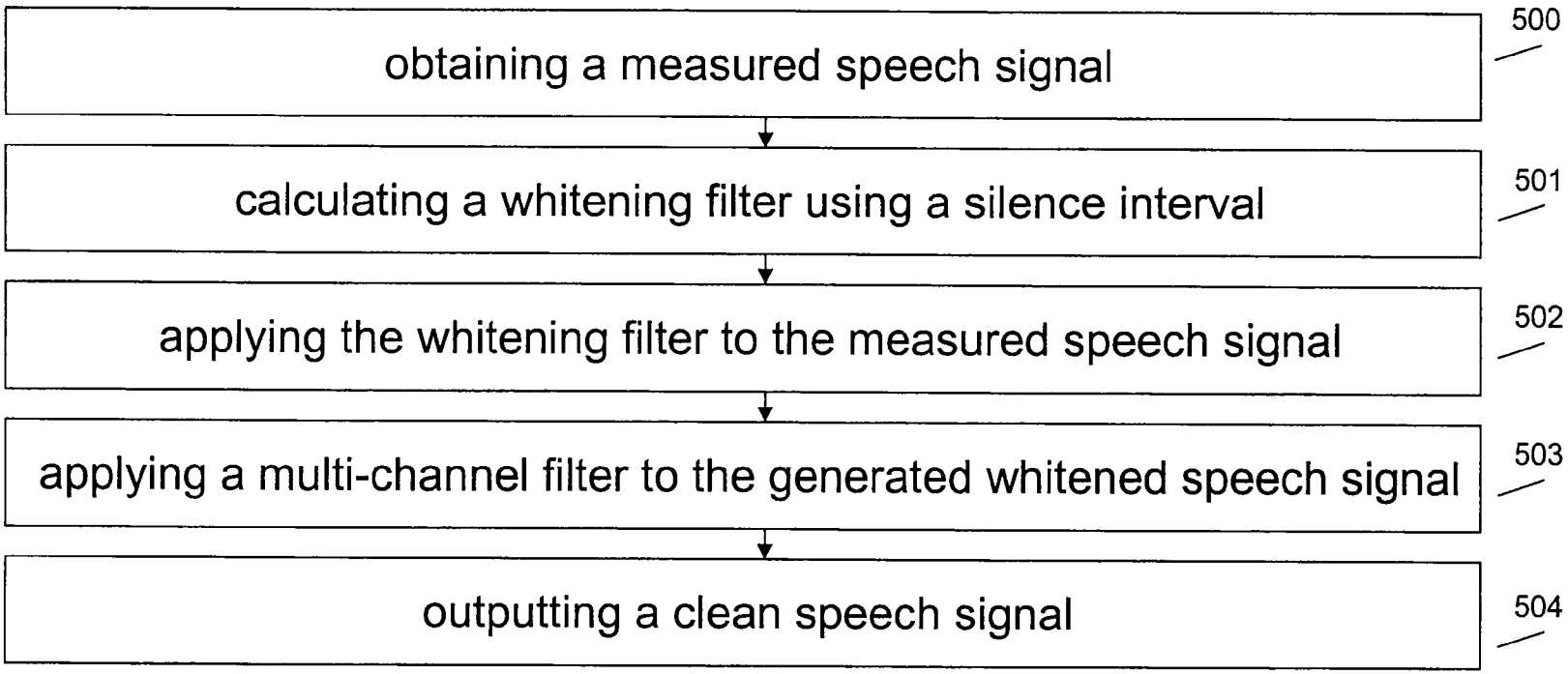
FIG. 5: illustrates a flow diagram of a method of one embodiment of the present invention.

FIG. 5 illustrates an example of one embodiment of the present invention. In steps 500-504 of FIG. 5 there is illustrated a speech enhancement method. Specifically, in 500 there is shown a step of obtaining a measured speech signal using at least one input microphone. In 501 there is illustrated a step of calculating a whitening filter using a silence interval in the obtained measured speech signal. In 502 there is shown a step of applying the whitening filter to the measured speech signal to generate a whitened speech signal in which noise components present in the measured speech signal are whitened. In 503 there is shown a step of estimating a clean speech signal by applying a multi-channel filter to the generated whitened speech signal. Finally, in 504 there is shown a step of outputting the clean speech signal via an audio device.

Figure 6:
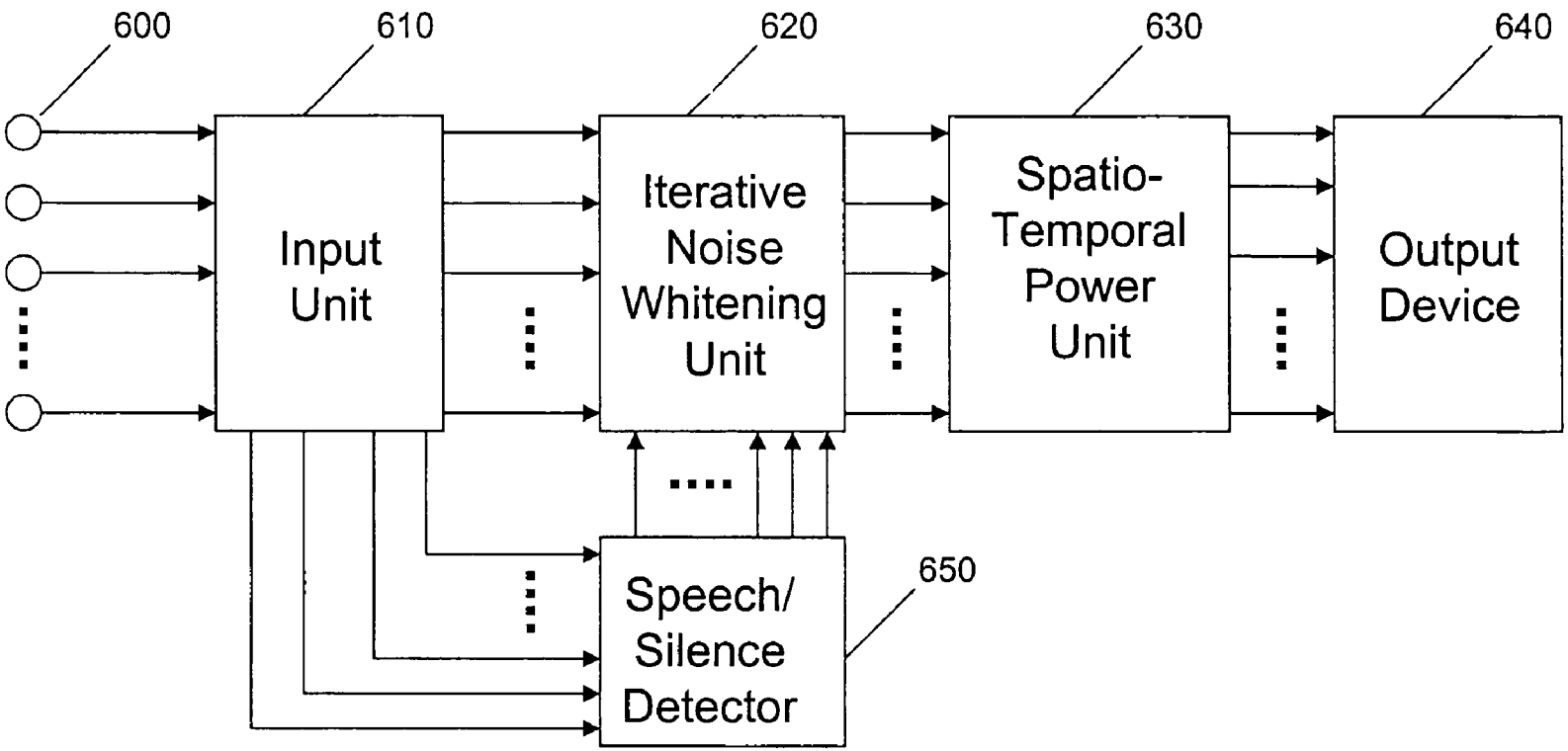
FIG. 6: illustrates a block diagram of one embodiment of the present invention.

In FIG. 6 there is shown an embodiment of the invention in which a device that performs speech enhancement is shown. In FIG. 6 there is illustrated a first circuit that obtains a measured speech signal using at least one input microphone 600. The first circuit includes, for example, an input unit 610 that functions to convert the measured speech into a form usable by the second and third circuits. In addition, there is shown a second circuit which calculates a whitening filter using a silence interval in the obtained measured speech signal and applies the whitening filter to the measured speech signal to generate a whitened speech signal in which noise components present in the measured speech signal are whitened. The second circuit includes, for example, the iterative noise whitening unit 620 which calculates and uses the whitening filter using the method described above. The iterative noise whitening unit 620 also uses data from the speech/silence detector 650, which determines when no speech is included in the signal. Also illustrated in FIG. 6 is a third circuit that estimates a clean speech signal by applying a multi-channel filter to the generated whitened speech signal, and outputs the clean speech signal to an audio output device 640. The third circuit includes, for example, a Spatio-Temporal Power Unit 630 which applies a multi-channel filter to the speech signal using the method described above and outputs the clean speech signal to the output device 640.

All embodiments of the present invention conveniently may be implemented using a conventional general-purpose computer, personal media device, cellular telephone, or micro-processor programmed according to the teachings of the present invention, as will be apparent to those skilled in the computer art. The present invention may also be implemented in an attachment that works with other computational devices, such as a personal headset or recording apparatus that transmits or otherwise makes its processed audio signal available to these other computational devices in its operation. Appropriate software may readily be prepared by programmers of ordinary skill based on the teachings of the present disclosure, as will be apparent to those skilled in the software art.

A computer or other computational device may implement the methods of the present invention, wherein the computer or computational devices housing houses a motherboard which contains a CPU, memory (e.g., DRAM, ROM, EPROM, EEPROM, SRAM, SDRAM, and Flash RAM), and other optional special purpose logic devices (e.g., ASICs) or configurable logic devices (e.g., GAL and reprogrammable FPGA). The computer or computational device also includes plural input devices, (e.g., keyboard and mouse), and a display card for controlling a monitor or other visual display device. Additionally, the computer or computational device may include a floppy disk drive; other removable media devices (e.g. compact disc, tape, electronic flash memory, and removable magneto-optical media); and a hard disk or other fixed high density media drives, connected using an appropriate device bus (e.g., a SCSI bus, an Enhanced IDE bus, an Ultra DMA bus, or another standard communications bus). The computer or computational device may also include an optical disc reader, an optical disc reader/writer unit, or an optical disc jukebox, which may be connected to the same device bus or to another device bus. Computational devices of a similar nature to the above description include, but are not limited to, cellular telephones, personal media devices, or other devices enabled with computational capability using microprocessors or devices with similar numerical computing capability. In addition, devices that interface with such systems can embody the proposed invention through their interaction with the host device.

Examples of computer readable media associated with the present invention include optical discs, hard disks, floppy disks, tape, magneto-optical disks, PROMs (e.g., EPROM, EEPROM, Flash EPROM), DRAM, SRAM, SDRAM, and so on. Stored on any one or on a combination of these computer readable media, the present invention includes software for controlling both the hardware of the computational device and for enabling the computer to interact with a human user. Such software may include, but is not limited to, device drivers, operating systems and user applications, such as development tools. Computer readable medium may store computer program instructions (e.g., computer code devices)

which when executed by a computer causes the computer to perform the method of the present invention. The computer code devices of the present invention may be any interpretable or executable code mechanism, including but not limited to, scripts, interpreters, dynamic link libraries, Java classes, and complete executable programs. Moreover, parts of the processing of the present invention may be distributed (e.g., between (1) multiple CPUs or (2) at least one CPU and at least one configurable logic device) for better performance, reliability, and/or cost.

The invention may also be implemented by the preparation of application specific integrated circuits or by interconnecting an appropriate network of conventional component circuits, as will be readily apparent to those skilled in the art.

Numerous modifications and variations of the present invention are possible in light of the above teachings. Of course, the particular hardware or software implementation of the present invention may be varied while still remaining within the scope of the present invention. It is therefore to be understood that within the scope of the appended claims and their equivalents, the invention may be practiced otherwise than as specifically described herein.

The invention claimed is:

1. A speech enhancement method, comprising:

obtaining a speech signal using at least one input microphone;

calculating a whitening filter using a silence interval in the obtained speech signal;

applying the whitening filter to the obtained speech signal to generate a whitened speech signal in which noise components present in the obtained speech signal are whitened;

estimating a clean speech signal by applying a multi-channel filter to the whitened speech signal; and outputting the clean speech signal via an audio device, wherein the calculating step comprises: iteratively updating the whitening filter as an FIR filter sequence using NS noise samples from the obtained speech signal, NS being a positive integer, and wherein the step of iteratively updating the whitening filter comprises updating the matrix FIR filter sequence $W_p(k)$ using the iterative equation:

$$W_p(k+1) = (1+\mu)c(k)W_p(k) - \mu\frac{c(k)}{d(k)}\tilde{U}_p(k), \quad (26)$$

$$0 \le p \le L$$

where $$d(k) = \frac{1}{n}\sum_{i=1}^{n}\sum_{j=1}^{n}\sum_{p=0}^{L}|g_{ijp}(k)|,$$

and $$c(k) = \frac{1}{d(k)}$$

are gradient scaling factors, i, j, k, and p are integers, μ is a real number, L is the integer length of the FIR filter, n is a number of microphones, k is an iteration index, μ is a step size, g()is a scaling function where $g_{ijp}$ are elements of a coefficient matrix $G_{vp}(k)$ that defines $\tilde{U}_p(k)$, or using the iterative equation:

$$W_p(k+1) = (1+\mu)c(k)W_p(k) - \mu\frac{c(k)}{d(k)}U_p(k), \quad (20)$$

where $$d(k) = \frac{1}{n}\sum_{i=1}^{n}\sum_{j=1}^{n}\sum_{p=0}^{L}|g_{ijp}(k)|,$$

and $$c(k) = \frac{1}{d(k)}$$

are gradient scaling factors, i, j, k, and p are integers, μ is a real number, n is a number of microphones, k is an iteration index, μis a step size, g( )is a scaling function where $g_{ijp}$ are elements of a coefficient matrix $G_p(k)$ that defines $U_p(k)$.

2. The method of claim 1, wherein the obtaining step comprises:

measuring an output of an n-microphone array, the output including correlated noise, wherein n is an integer greater than or equal to 2.

3. The method of claim 1, wherein the calculating step comprises:

detecting the silence interval in the obtained speech signal.

4. The method of claim 1, wherein the applying step comprises calculating the whitened speech signal using the equation:

$$\tilde{y}_k(l) = \sum_{p=0}^{L} W_p(k)y(l-p),$$

wherein y(l) is the obtained speech signal, ỹ (l) is the whitened speech signal, $W_p(k)$is the whitening filter, which is an FIR filter sequence of integer length L, p, k, and l are integers, l is a time index, and k is an iteration index.

5. The method of claim 1, wherein the estimating step comprises applying the multi-channel filter to the generated whitened speech signal, the multi-channel filter being a filter sequence that maximizes a power of the clean speech signal subject to paraunitary constraints on the filter sequence.

6. The method of claim 5, wherein the estimating step comprises:

determining the filter sequence $\{b_p(k)\}$ that maximizes $$\mathcal{J}(\{b_p\}) = \frac{1}{2}\sum_{k=1}^{N}\hat{s}_k^2(l)$$

such that $$\sum_{p=0}^{L} b_p b_{p+q}^T = \delta_q, \; -\frac{L}{2} \le q \le \frac{L}{2}$$

by using a gradient ascent method, wherein L is the integer length of the filter sequence, p, k, and l are integers, $\hat{s}_k(l)$ is the estimated clean speech signal at time l and iteration k, l is a time index, and k is an iteration index.

7. A non-transitory computer-readable medium storing instructions that, when executed on a computer, cause the computer to perform a speech enhancement method comprising the steps of:

obtaining a speech signal using at least one input microphone;

calculating a whitening filter using a silence interval in the obtained speech signal;

applying the whitening filter to the obtained speech signal to generate a whitened speech signal in which noise components present in the obtained speech signal are whitened;

estimating a clean speech signal by applying a multi-channel filter to the generated whitened speech signal; and outputting the clean speech signal via an audio device wherein the calculating step comprises: iteratively updating the whitening filter as an FIR filter sequence using NS noise samples from the obtained speech signal, NS being a positive integer, and wherein the step of iteratively updating the whitening filter comprises updating the matrix FIR filter sequence $W_p(k)$ using the iterative equation:

$$W_p(k+1) = (1+\mu)c(k)W_p(k) - \mu\frac{c(k)}{d(k)}\tilde{U}_p(k), \quad (26)$$

$$0 \le p \le L$$

where $$d(k) = \frac{1}{n}\sum_{i=1}^{n}\sum_{j=1}^{n}\sum_{p=0}^{L}|g_{ijp}(k)|,$$

and $$c(k) = \frac{1}{d(k)}$$

are gradient scaling factors i, j, k, and p are integers, μ is a real number, L is the integer length of the FIR filter, n is a number of microphones, k is an iteration index, μ is a step size, g( )is a scaling function where $g_{ijp}$ are elements of a coefficient matrix $G_{vp}(k)$ that defines $\hat{U}_p(k)$, or using the iterative equation:

$$W_p(k+1) = (1+\mu)c(k)W_p(k) - \mu\frac{c(k)}{d(k)}U_p(k), \quad (20)$$

where $$d(k) = \frac{1}{n}\sum_{i=1}^{n}\sum_{j=1}^{n}\sum_{p=0}^{L}|g_{ijp}(k)|,$$

and $$c(k) = \frac{1}{d(k)}$$

are gradient scaling factors, i, j, k, and p are integers, μ is a real number, n is a number of microphones, k is an iteration index, μ is a step size, g( ) is a scaling function where $g_{ijp}$ are elements of a coefficient matrix $G_p(k)$ that defines $U_p(k)$.

8. A device configured to perform speech enhancement, comprising:

a first circuit configured to obtain a speech signal using at least one input microphone;

a second circuit configured to calculate a whitening filter using a silence interval in the obtained speech signal, and to apply the whitening filter to the obtained speech signal to generate a whitened speech signal in which noise components present in the obtained speech signal are whitened; and a third circuit configured to estimate a clean speech signal by applying a multi-channel filter to the generated whitened speech signal, and to output the clean speech signal to an audio device, wherein the second circuit is further configured to calculate the whitening filter by iteratively updating the whitening filter as an FIR filter sequence using NS noise samples from the obtained speech signal, NS being a positive integer, and wherein the step of iteratively updating the whitening filter comprises updating the matrix FIR filter sequence $W_p(k)$ using the iterative equation:

$$W_p(k+1) = (1+\mu)c(k)W_p(k) - \mu\frac{c(k)}{d(k)}\tilde{U}_p(k), \quad (26)$$

$$0 \le p \le L$$

where $$d(k) = \frac{1}{n}\sum_{i=1}^{n}\sum_{j=1}^{n}\sum_{p=0}^{L}|g_{ijp}(k)|,$$

and $$c(k) = \frac{1}{d(k)}$$

are gradient scaling factors, i, j, k, and p are integers, μ is a real number, L is the integer length of the FIR filter, n is a number of microphones, k is an iteration index, μ is a step size, g( ) is a scaling function where $g_{ijp}$ are elements of a coefficient matrix $G_{vp}(k)$ that defines $\tilde{U}_p(k)$, or using the iterative equation:

$$W_p(k+1) = (1+\mu)c(k)W_p(k) - \mu\frac{c(k)}{d(k)}U_p(k), \quad (20)$$

where $$d(k) = \frac{1}{n}\sum_{i=1}^{n}\sum_{j=1}^{n}\sum_{p=0}^{L}|g_{ijp}(k)|,$$

and $$c(k) = \frac{1}{d(k)}$$

are gradient scaling factors, i, j, k, and p are integers, μ is a real number, n is a number of microphones, k is an iteration index, μ is a step size, g( ) is a scaling function where $g_{ijp}$ are elements of a coefficient matrix $G_p(k)$ that defines $U_p(k)$.

9. The device of claim 8, further comprising:

a fourth circuit configured to detect the silent interval in the obtained speech signal.

* * * * *